US008292681B2

(12) United States Patent
Duff et al.

(10) Patent No.: US 8,292,681 B2
(45) Date of Patent: Oct. 23, 2012

(54) WATER RECREATION DEVICE

(75) Inventors: Glen Wade Duff, Williamsburg, VA (US); Timothy Walter Zeckser, Denver, CO (US)

(73) Assignee: Zup LLC, Williamsburg, VA (US)

( * ) Notice: Subject to any disclaimer, the term of this patent is extended or adjusted under 35 U.S.C. 154(b) by 163 days.

(21) Appl. No.: 12/592,759

(22) Filed: Dec. 2, 2009

(65) Prior Publication Data

US 2010/0151754 A1 Jun. 17, 2010

Related U.S. Application Data

(60) Provisional application No. 61/200,637, filed on Dec. 2, 2008.

(51) Int. Cl.
*B63B 35/73* (2006.01)

(52) U.S. Cl. ..... 441/65; 441/70; 441/79

(58) Field of Classification Search ..... 441/65, 441/70, 74, 79
See application file for complete search history.

(56) References Cited

U.S. PATENT DOCUMENTS 3,918,114 A * 11/1975 Schmitt ..... 441/68
4,678,444 A * 7/1987 Monreal ..... 441/65
5,083,955 A * 1/1992 Echols ..... 441/65
5,163,860 A * 11/1992 Clark ..... 441/65
5,427,047 A * 6/1995 Woodfin et al. ..... 114/253
5,447,116 A * 9/1995 Kobayashi ..... 114/363
5,634,834 A * 6/1997 Cole et al. ..... 441/65
5,797,779 A * 8/1998 Stewart ..... 441/74
5,820,430 A * 10/1998 Hornsby et al. ..... 441/65
6,585,549 B1 * 7/2003 Fryar ..... 441/79
7,216,600 B1 * 5/2007 Hamilton et al. ..... 114/242

* cited by examiner

*Primary Examiner* — Edwin Swinehart

(74) *Attorney, Agent, or Firm* — Mark R. Malek, Esq.; Eugene R. Quinn, Jr., Esq.; Zies Widerman & Malek

(57) ABSTRACT

A water recreation device and method of use is contemplated having advantages such as improved stability, maneuverability and ease of use. Embodiments of the contemplated water recreation device include a riding board, handles and a tow hook assembly that are configured to allow a rider to more easily transition to a standing forward-facing position while riding the device. The contemplated device may also include foot bindings or foot grips for added ride stability. The device may alternately include rails disposed on the bottom surface of the riding board. Such rails are adapted to channel water toward the rear bottom section of the riding board to cause the device to achieve an approximately planar orientation relative to the surface of a body of water. This planar orientation provides positioning and stability that further improves the ease of transitioning to a standing position.

12 Claims, 16 Drawing Sheets

WATER RECREATION DEVICE

RELATED APPLICATIONS

This application claims the benefit of earlier priority based upon the filing of a provisional patent application, Application No. 61/200,637 (filed on Dec. 2, 2008).

FIELD OF THE INVENTION

The present invention relates generally to the field of water recreation devices and particularly to a water recreation device suitable for riding in a forward-facing direction while being towed behind a water vehicle.

BACKGROUND

Many different types of water riding boards and devices currently exist. Some existing single boards allow a rider to be towed behind a boat or jet ski. The width of such boards requires one to ride with feet in a front to back position according to the direction of travel. This is the traditional standing and riding position on a single board. Surf boards, wakeboards and skate boards have relied on this technique for many years. Other prior art devices such as water skis allow for riding in a forward-facing direction with a side-by side foot configuration; however, these devices employ the use of a separate element (e.g. a ski) for each foot. Other solutions such as that disclosed in U.S. Pat. No. 6,306,000 provide a single board that may be operated in a forward facing direction while standing with feet in a side-by-side configuration.

Applicant has recognized that existing solutions suffer a variety of drawbacks related to stability, maneuverability and ease of use. Though the water recreation industry offers many different types of water riding boards and devices, known devices still require a physical capacity or large learning capacity that prevent many riders from achieving full use and enjoyment of these products. Many users are often limited in their experience with current water sports devices due to physical limitations of size and weight, lack of upper body strength, coordination, or athletic prowess. Moreover, the movement and position required to ride standing up on a traditional wakeboard or water skis is often awkward, uncomfortable, or unmanageable for many potential water sport participants. The process of getting to a standing position on existing water recreation devices is a physically strenuous process, utilizing great amounts of upper body strength. Some potential users such as very large individuals, like football players, are unable to participate in this popular activity.

A need thus exists for an improved water recreation device that does not suffer the drawbacks of existing solutions.

SUMMARY OF THE INVENTION

The disclosed invention advantageously fills the aforementioned deficiencies by providing a water recreation device, which enables individuals who could not ordinarily partake in the activity of towed water boarding.

In its most basic version, the water sports device disclosed herein is made up of the following components: a floatable riding board having a mounted tow hook on the topside of the board, with one particular placement being the front leading edge of the board, although other placements can and will suffice and are intended to be within the scope of this disclosure. The tow hook is mounted to the board, such as for example through the use of bolts. Alternatively, the tow hook can be built into the board by being molded and formed such that the board and tow hook are one continuous whole.

Versions of the water sports device can additionally have one or more of the following: (1) kneepads adhered to the top side of the riding board; (2) foot grips that will be attached on the top side of the riding board; (3) foot bindings that will be attached to the top side of the riding board; (4) bottom fins that will be attached to the underside of the riding board on either the front, back, or middle sections respectively; (5) one or more handles that will be attached to the top side of the riding board; and (6) rails on the underside of the board to create a channeling or funneling effect with respect to the water sweeping beneath the board so as to direct a concentrated water flow into a condensed space toward the middle back end of the board, thus providing an upward lift and making it easier to achieve planing. Particular modifications of the aforementioned optional features include but are not limited to the kneepads being located in the back half of the top side of the board, foot grips being attached near the middle of the board lengthwise, foot bindings being secured so as to create an arch above the foot grips, and two handles being attached just inside the leading edge of the board and opposite one another (see for example FIG. 2A through FIG. 2I). While the embodiments of the device shown throughout typically have two handles, a single handle on one side is within the scope of this disclosure, as is a single handle with placement across the leading edge or relatively close to the front of the board is also within the scope of this disclosure.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of what has been invented by the inventor.

DETAILED DESCRIPTION

Reference will now be made in detail to the present exemplary embodiments of the invention, examples of which are illustrated in the accompanying drawings.

Figure 1A:
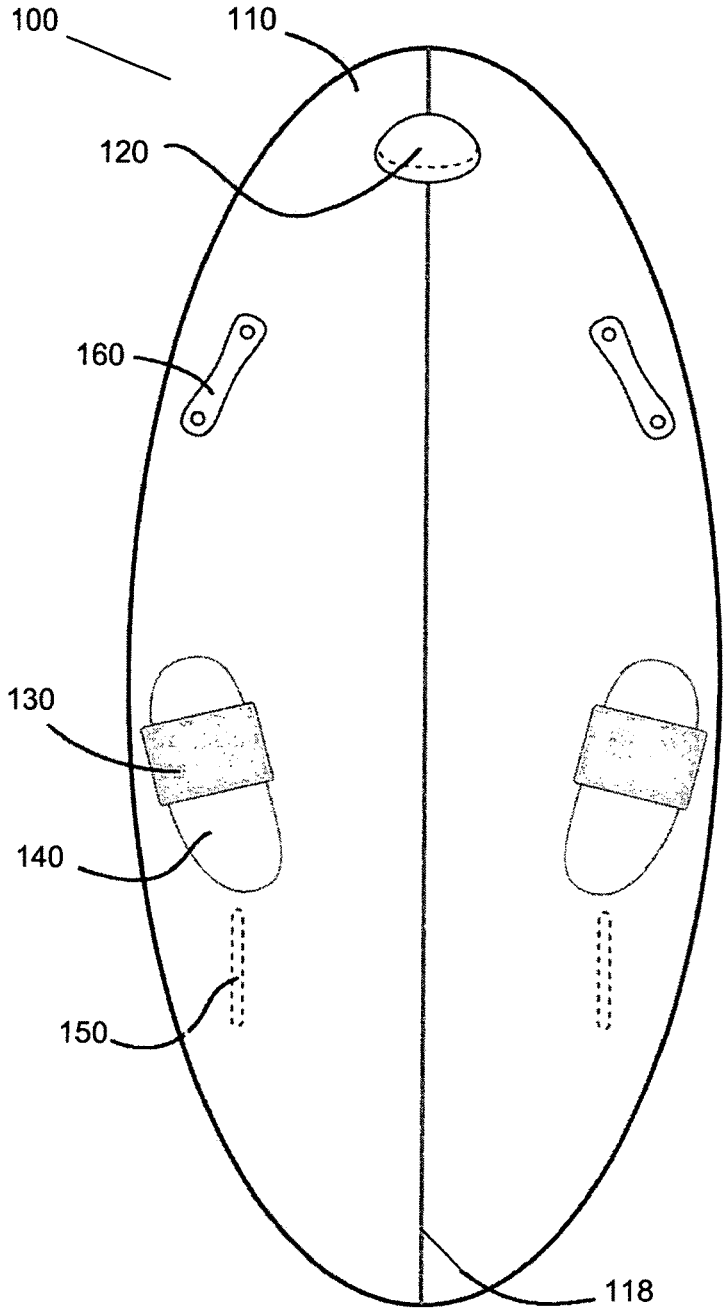
FIG. 1A is a diagram illustrating a top view of a water sports device in accordance with an exemplary embodiment of the invention.

Referring now to FIG. 1A, a diagram is shown illustrating a top view of a water sports device 100 in accordance with an exemplary embodiment of the invention. As shown, the water sports device 100 includes a riding board 110 and a tow hook assembly 120. The water sports device 100 may also include foot bindings 130 (e.g. foot straps) attached to a middle section of a top side of the riding board 110. Knee padding may also be adhered to a back section of the top side of the riding board 110 (shown as element 710 in FIG. 7A). Knee padding may alternatively be adhered to both front and back sections of the top side of the riding board 110 (shown as element 810 in FIG. 8A). Foot grips 140 may also be attached to the middle section of the top side of the riding board 110. The water sports device 100 may also include one or more fins 150 attached to an underside of the riding board 110. The fins 150 may be positioned on either the front, back, or middle sections of the underside of the riding board 110. The device 100 may also include two handles 160 attached to a front section of the top side of the riding board 110. By way of example, the riding board 110 may be substantially elliptical in shape. In one particular and illustrative, yet non limiting, embodiment of the riding board 110 it may at its widest section have a width of approximately 17 inches and at its longest section a length of about 53.5 inches. Of course, these measurements are merely illustrative and boards of any width and any length that include the features described herein are intended to be within this disclosure and make up the overall invention, which has many different embodiments. By way of further illustration, other riding boards may have a width at the widest point of 28 inches and length of 59 inches, or with respect to a particular version of the board show and discussed infra (see FIG. 5*a* for example) the board may have a wing to wing width of 58 inches and a length of 37 inches.

The riding board 110 may be comprised of a material such as but not limited to: wood, molded plastic, or foam with a fiberglass coating. The riding board 110 may also have a stringer 118 longitudinally disposed along the center of the board for providing structural support. It is noted that the riding board 110 may alternatively be shaped as a diamond, a circle, an oval, or a polygon, the shape being selected based on the desired performance.

FIG. 2A through FIG. 2I illustrate a not-limiting set of alternate riding board shapes and fin configurations. The tow hook assembly 120 includes a tow hook 122 having a rearward facing convex section 124 sized to receive a tow rope bar (shown as element 910 in FIG. 9A). The tow hook assembly 120 may also include fasteners (not shown) such as screws (such as but not limited to metal screws or wood screws), nuts, and bolts for attaching the tow hook 122 to the riding board 110. The tow hook 122 may be comprised of a material such as but not limited to wood, metal, rubber, or fiberglass. The tow hook 122 and riding board 110 may also be formed as a single component (e.g. by injection molding). In such an embodiment, the tow hook 122 and board 110 may be comprised of the same material. The foot grips 140 and knee pads are preferably comprised of neoprene but may also be comprised of a material such as but not limited to rubber or other suitable flexible waterproof materials. The foot grips 140 and knee pads may be attached to the board by way of an adhesive, such as for example Very High Bond (VHB) tape. The foot bindings 130 are preferably comprised of neoprene but may also be comprised of a material such as but not limited to rubber or other suitable synthetic waterproof materials. The foot bindings 130 may be attached directly to the top surface of the riding board 110 or to the foot grips 140 by way of screws (such as but not limited to metal screws or wood screws), nuts, bolts, or adhesives. The fins 150 are preferably comprised of plastic but may also be comprised of a material such as but not limited to metal or fiberglass. The fins 150 are preferably mounted to the underside of the riding board 110 into slots configured to allow positions and sizes of fins 150 to be adjusted. However, the fins 150 may also be attached directly to the underside of the riding board 110 by way of fasteners such as metal screws, nuts, bolts, or adhesives. The handles 160 may be attached directly to the top surface of the riding board 110 by way of metal screws, nuts, bolts, or adhesives. The handles are preferably comprised of rubber but may also be comprised of a material such as but not limited to plastic (or another durable polymer), wood, or metal.

Figure 1C:
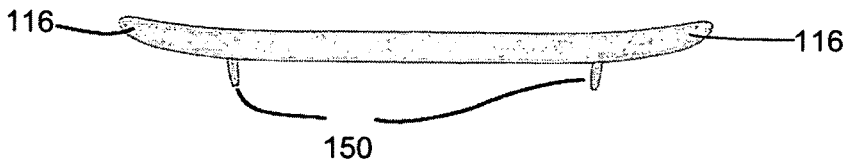
FIG. 1C is a diagram illustrating an end view of the exemplary water sports device of FIG. 1A.
Figure 1B:
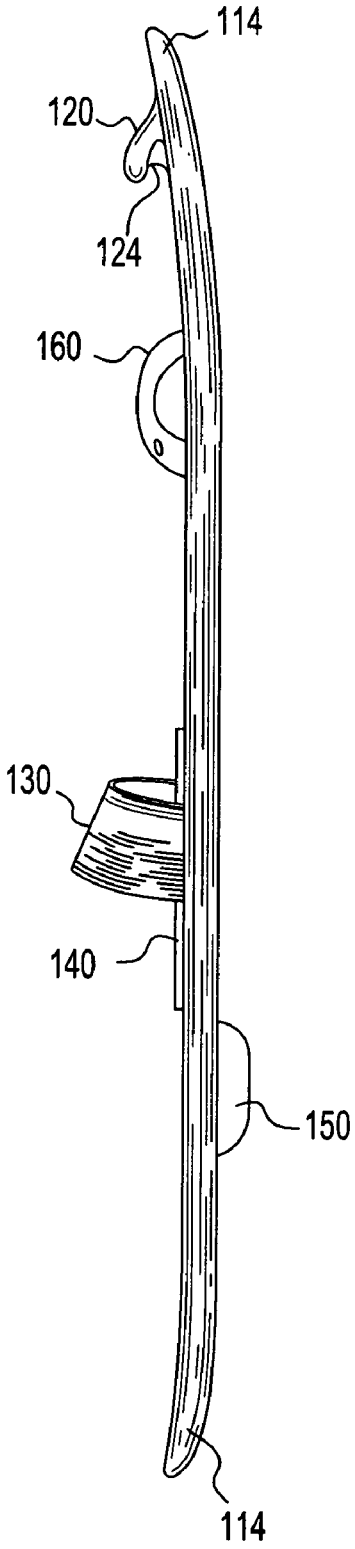
FIG. 1B is a diagram illustrating a side view of the exemplary water sports device of FIG. 1A.

Referring now to FIG. 1B, a diagram is shown illustrating a side view of the exemplary water sports device 100 of FIG. 1A. As shown, the riding board 110 has a front section 110 and rear section 114 each curving slightly upward away from the center of the riding board. This upward curvature of the front section 110 and rear section 114 mitigates the risk of the rider catching an edge while using the water sports device 100.

Referring now to FIG. 1C, a diagram is shown illustrating an end view of the exemplary water sports device 100 of FIG. 1A. As shown, the riding board 110 has side sections labeled generally as 116. Each side section 116 also curves slightly upward away from the center of the riding board 110. The upward curvature of the side sections 116 further mitigates the risk of the rider catching an edge while using the water sports device 100.

Figure 1D:
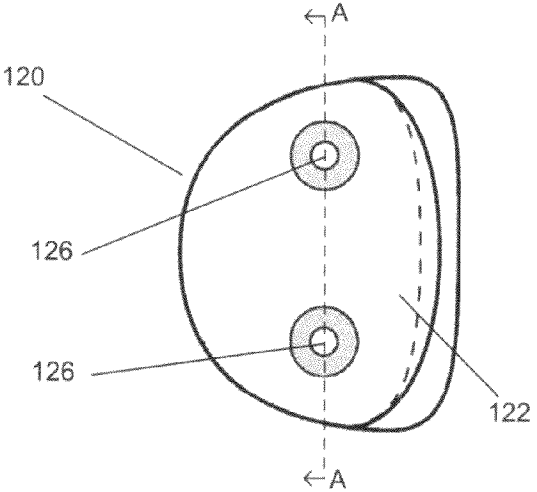
FIG. 1D is a diagram illustrating a top view of a tow hook assembly in accordance with the exemplary water sports device of FIG. 1A.
Figure 1E:
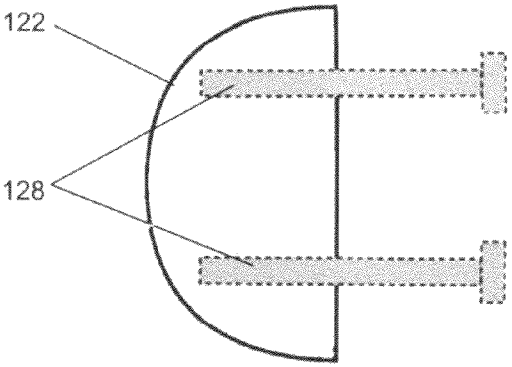
FIG. 1E is a diagram illustrating a section view of the exemplary tow hook assembly taken along line A-A, as indicated in FIG. 1D.
Figure 1F:
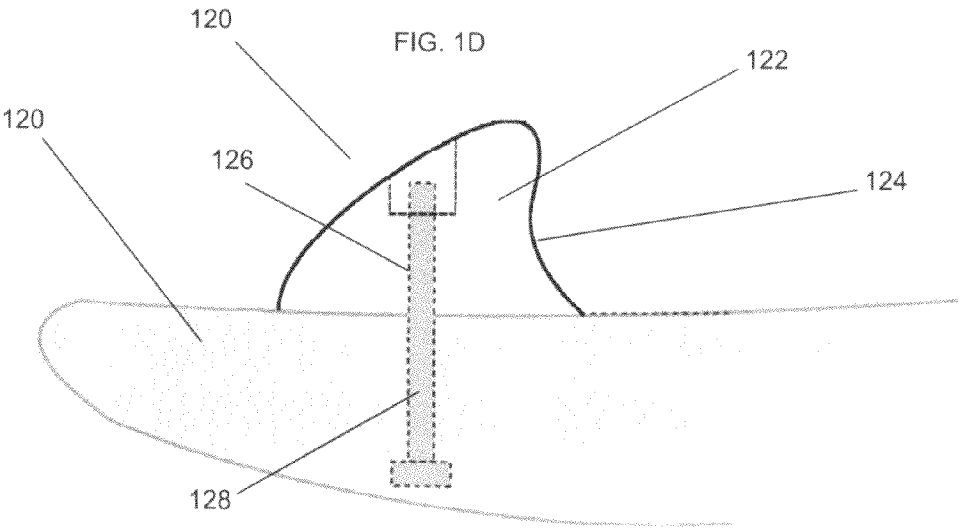
FIG. 1F is a diagram illustrating a side section view of the exemplary tow hook assembly of FIG. 1D configured with the water sports device of FIG. 1A.

Referring now to FIG. 1D, FIG. 1E and FIG. 1F, diagrams are shown illustrating top, section and side views of the tow hook assembly 120 in accordance with the exemplary water sports device 100 of FIG. 1A. As shown, the tow hook assembly 120 includes the tow hook 122 having rearward facing convex section 124. By way of example, the tow hook 122 may also include two holes 126 extending from a top surface of the tow hook 122 through to the bottom surface of the tow hook 122. The holes 126 are sized and positioned to receive two bolts labeled generally as 126 that protrude from the top surface of the riding board 110. The bolts 126 may be fixedly submerged or embedded below the surface of the riding board 110 and be of sufficient length to mate with a lock nut positioned at or near the top surface of the tow hook 122. By way of example, the holes 124 may be counterbored to allow a washer and lock nut to sit below the top surface of the tow hook 122. The bolts 128 thus provide a means for securing the tow hook 122 to the surface of the riding board 110. By way of example, the bolts may be 0.1875 inch diameter stainless steel bolts.

Figures 2A, 2B, 2C, 2D, 2E, 2F, 2G, 2H, 2I:
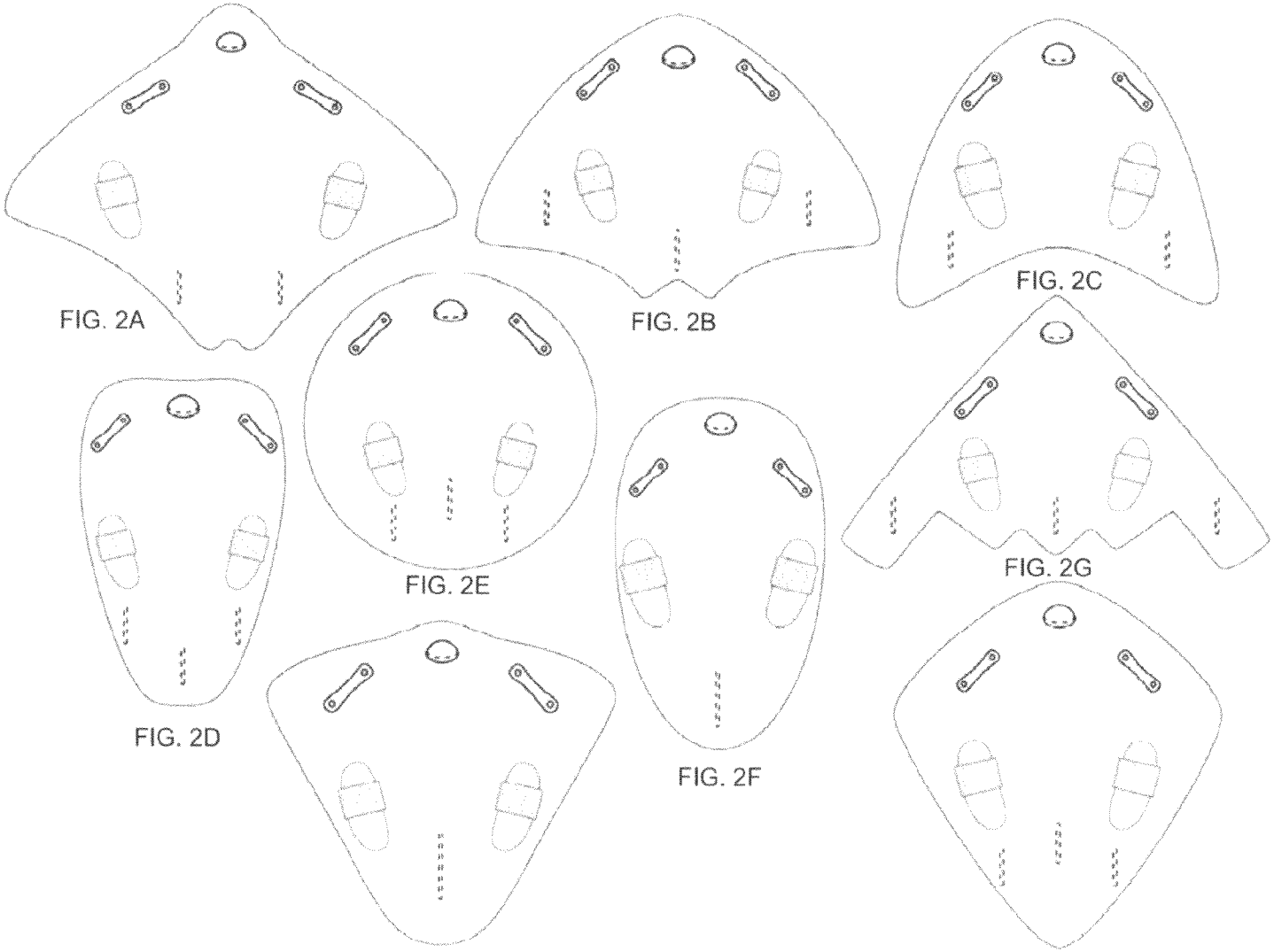
FIG. 2A through FIG. 2I are diagrams illustrating exemplary water sports devices having riding boards with varying shapes.

Referring now to FIG. 2A through FIG. 2I diagrams are shown illustrating water sports devices having varying riding board shapes and fin arrangements. As discussed, the riding board 110 may alternatively be shaped as a diamond, a circle, an oval, a polygon or other alternate shapes such as those shown in FIG. 2A through FIG. 2I. The shape of the riding board may be selected based on the desired performance or functional purpose. Riding boards having a larger overall width-to-length ratio provide good stability but lack maneuverability relative to riding boards having smaller width-to-length ratios, thus making them well-suited for inexperienced riders. Conversely, boards having relatively smaller width-to-length ratios such as the riding boards shown in FIG. 2D and FIG. 2F provide less stability but more maneuverability making them well-suited for more experienced riders who may desire to perform tricks or other advanced maneuvers while riding. In this manner the shape of the board can be selected based on the skill level of the rider or the functional purpose of the device.

Figure 3A:
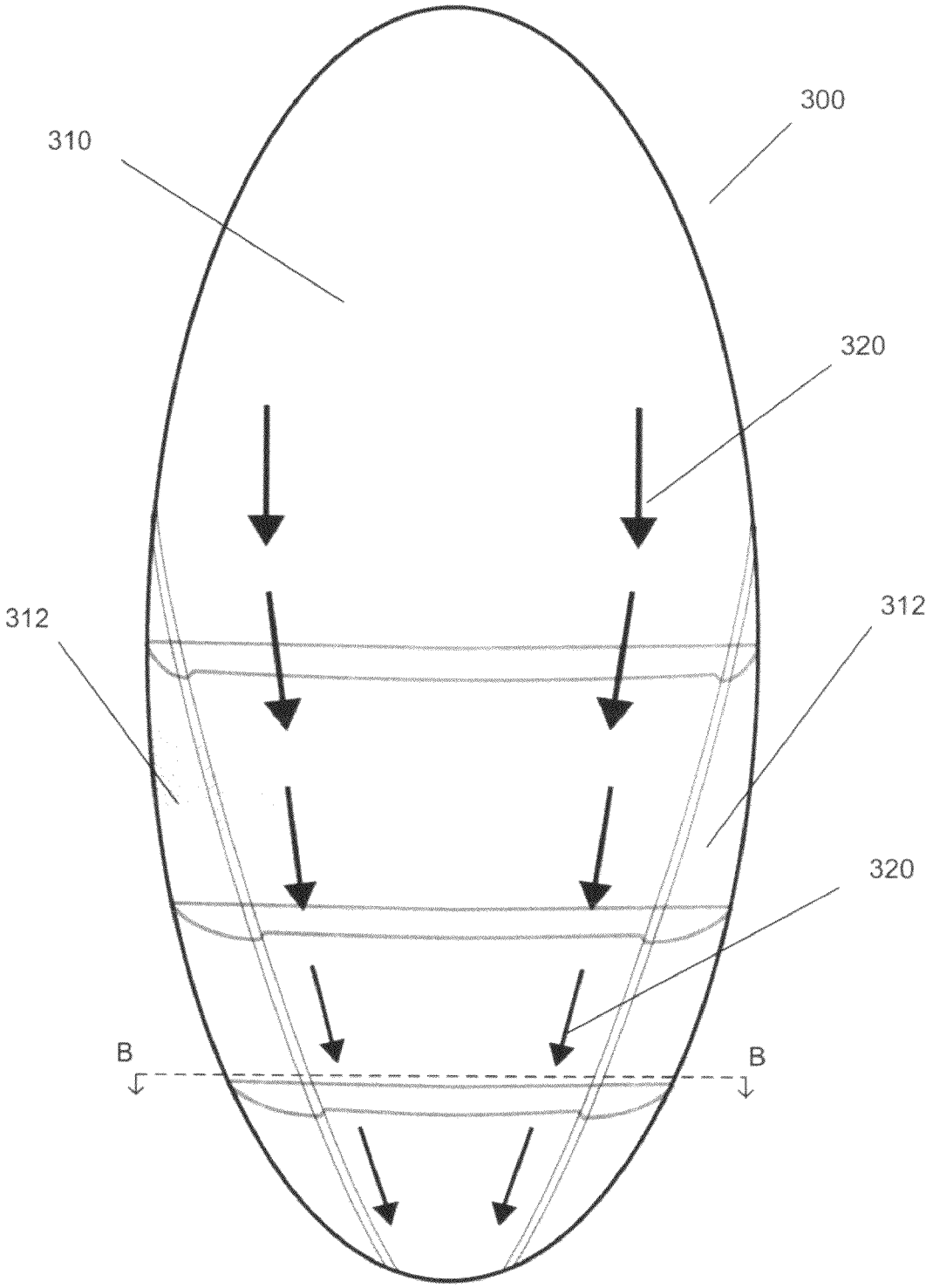
FIG. 3A is a diagram illustrating a bottom view of a water sports device in accordance with another exemplary embodiment of the invention.
Figure 3B:
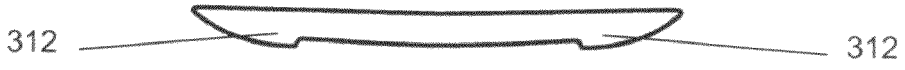
FIG. 3B is a diagram illustrating a section view of the exemplary water sports device of FIG. 3A taken along line B-B, as indicated in FIG. 3A.

Referring now to FIG. 3A and FIG. 3B, diagrams are shown illustrating a bottom view and a section view of a water sports device 300 in accordance with another exemplary embodiment of the invention. As shown, the water sports device 300 includes a riding board 310 that is configured in a similar manner to the water sports device 100 of FIG. 1. Water sports device 300 may further include elongated rails labeled generally as 312 that protrude below the bottom surface of the riding board 310 and extend generally from the forward section of the riding board 310 to the rear section of the riding board. The rails 312 are configured such that they are spaced closer to one another moving from the forward section of the riding board 310 to the rear section of the riding board. In this manner the rails provide a means for channeling water that moves across the relatively larger front section of the riding board 310 towards the relatively smaller rear section of the riding board, thus increasing the lift provided to the rear section of the riding board than would exist without such rails 312. The arrows labeled generally as 320 illustrate the channeling effect the rails 312 have on the flow of water across the bottom surface of the board 310. The rails 312 may extend along the full length of the board or a partial length of the board as shown. By way of example, in one illustrative embodiment the rails, which may be included on any version of the board (see FIG. 2A through FIG. 2I for illustrative boards of varying shape) may protrude approximately 0.25 inches to 1.5 inches below the bottom surface of the riding board 310. Certainly, the rails may protrude less than 0.25 inches or greater than 1.5 inches below the bottom surface of the board. The size, width and curvature of the rails are dictated by the desired channeling or funneling affect desired. The greater the channeling or funneling of water to the back end of the board the greater the lift provided and the easier the board will be to ride for novice users and those not ordinarily well adapted to engage in the activity as a result of age or physical characteristics such as being heavy. In providing increased lift the boards are easier to ride because it is easier to achieve planing, thereby opening up the activity to a variety of individuals without the skill, experience or physical characteristics typically necessary to engage in the activity.

Figure 4A:
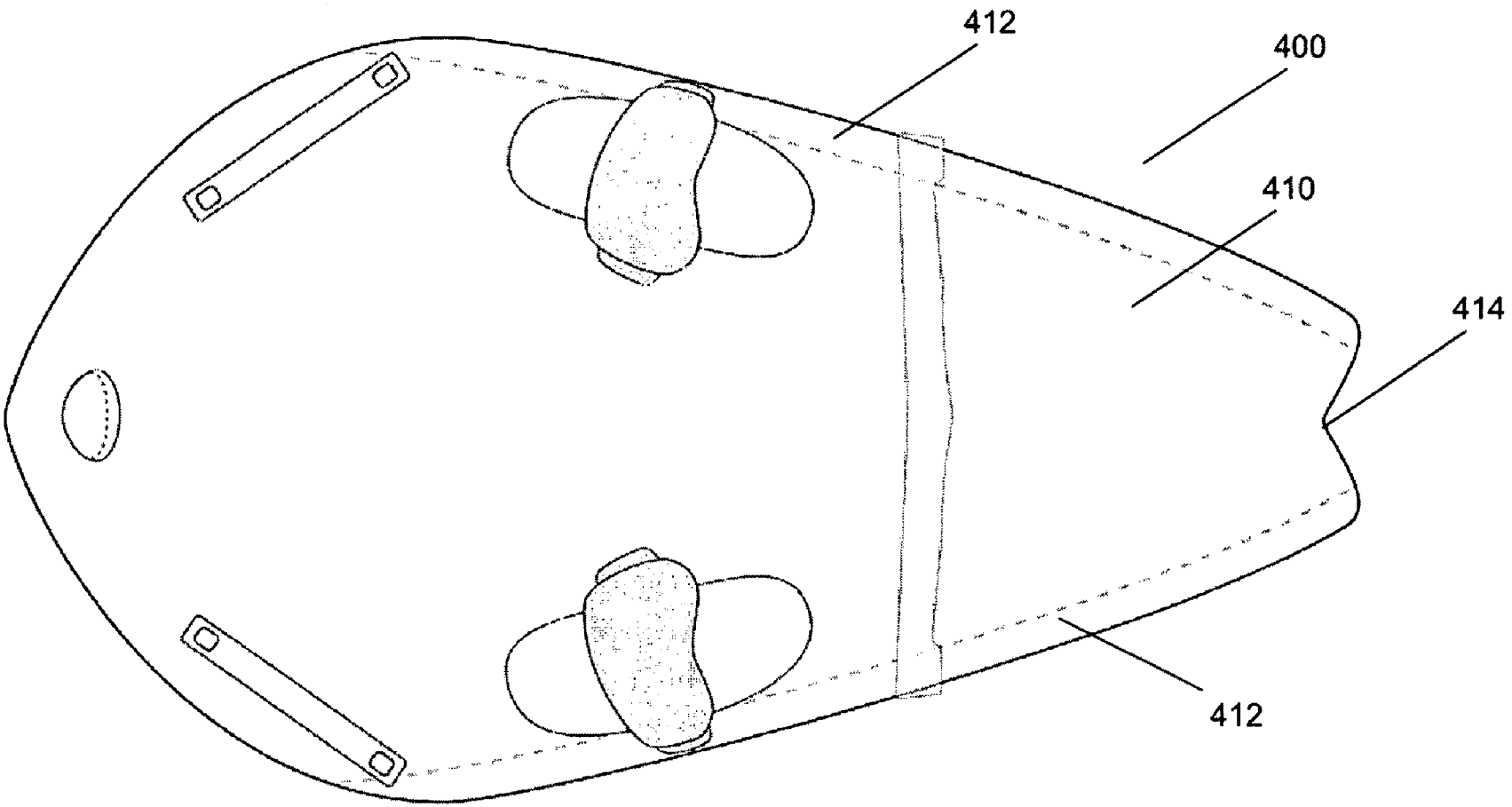
FIG. 4A is a diagram illustrating a top view of a water sports device in accordance with another exemplary embodiment of the invention.
Figure 4B:
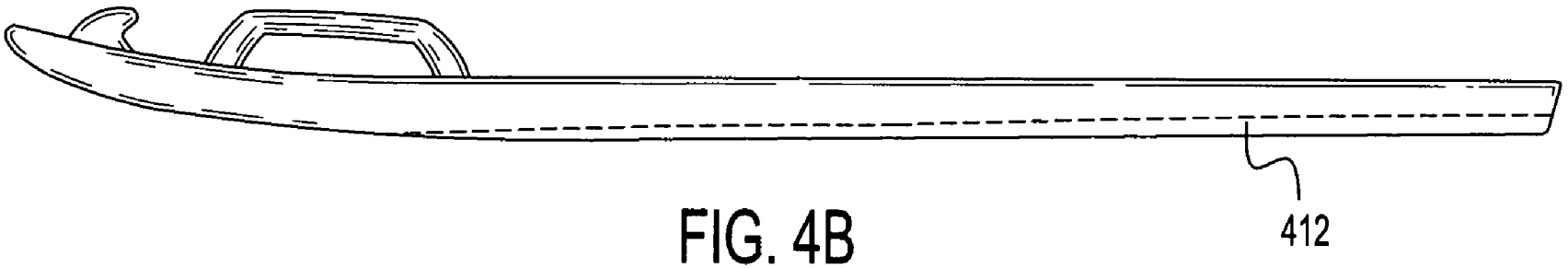
FIG. 4B is a diagram illustrating a side view of the exemplary water sports device of FIG. 4A.
Figure 4D:
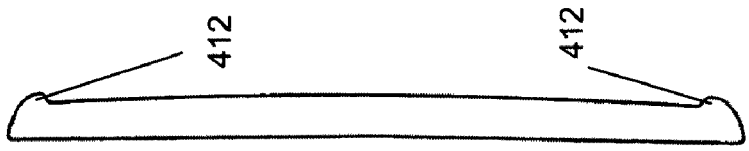
FIG. 4D is a diagram illustrating an end view of the exemplary water sports device of FIG. 4A.
Figure 4C:
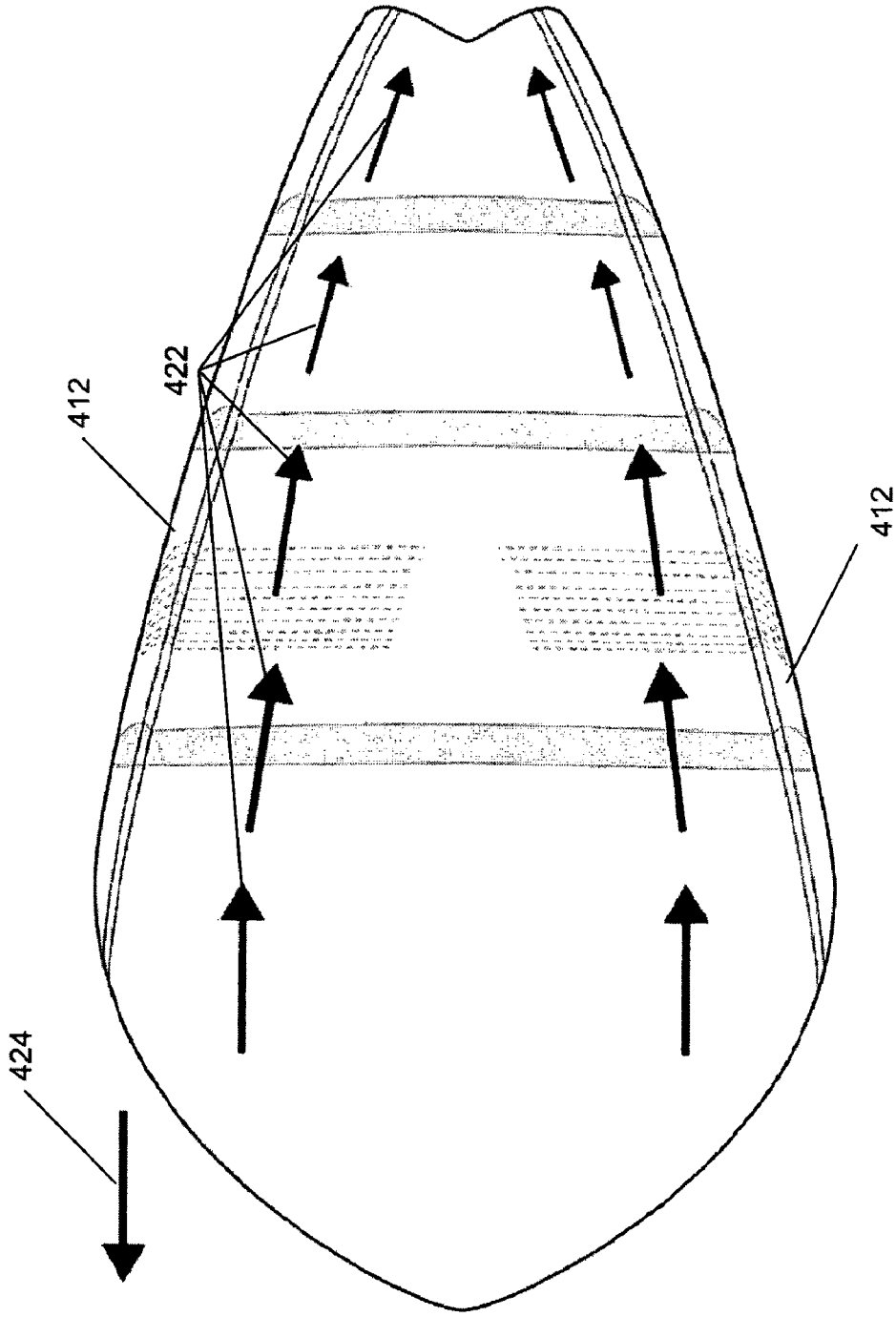
FIG. 4C is a diagram illustrating a bottom view of the exemplary water sports device of FIG. 4A.

Referring now to FIGS. 4A and 4B, diagrams are shown illustrating a top view and a side view of a water sports device 400 in accordance with another exemplary embodiment of the invention. Reference will also be made to FIG. 4C and FIG. 4D which further illustrate a bottom view and an end view respectively of the water sports device of FIG. 4A. As shown, the water sports device 400 includes a riding board 410 configured in a similar manner to the water sports device 100 of FIG. 1A. Water sports device 400 also includes a rear edge having a concave cutout section 414 (e.g. a fish tail shape) for providing increased maneuverability. The water sports device 400 further includes elongated rails labeled generally as 412 that protrude below the bottom surface of the riding board 410 and extend generally from the forward section of the riding board 410 to the rear section of the riding board. The rails 412 are configured such that they are spaced closer to one another moving from the forward section of the riding board 410 to the rear section of the riding board. In this manner the rails 412 provide a means for channeling water that moves across the relatively larger front section of the riding board 410 towards the relatively smaller rear section of the board, thus increasing the lift provided to the rear section of the board than would exist without such rails 412. The arrows labeled generally as 422 illustrate the channeling effect the rails 412 have on the flow of water across the bottom surface of the board 410 as the board moves forward as indicated by arrow 424. The rails 412 may extend along the full length of the board or along a partial length of the board as shown. By way of example the rails 412 may extend approximately 0.5 inches to 0.75 inches below the bottom surface of the riding board 410.

Figure 5A:
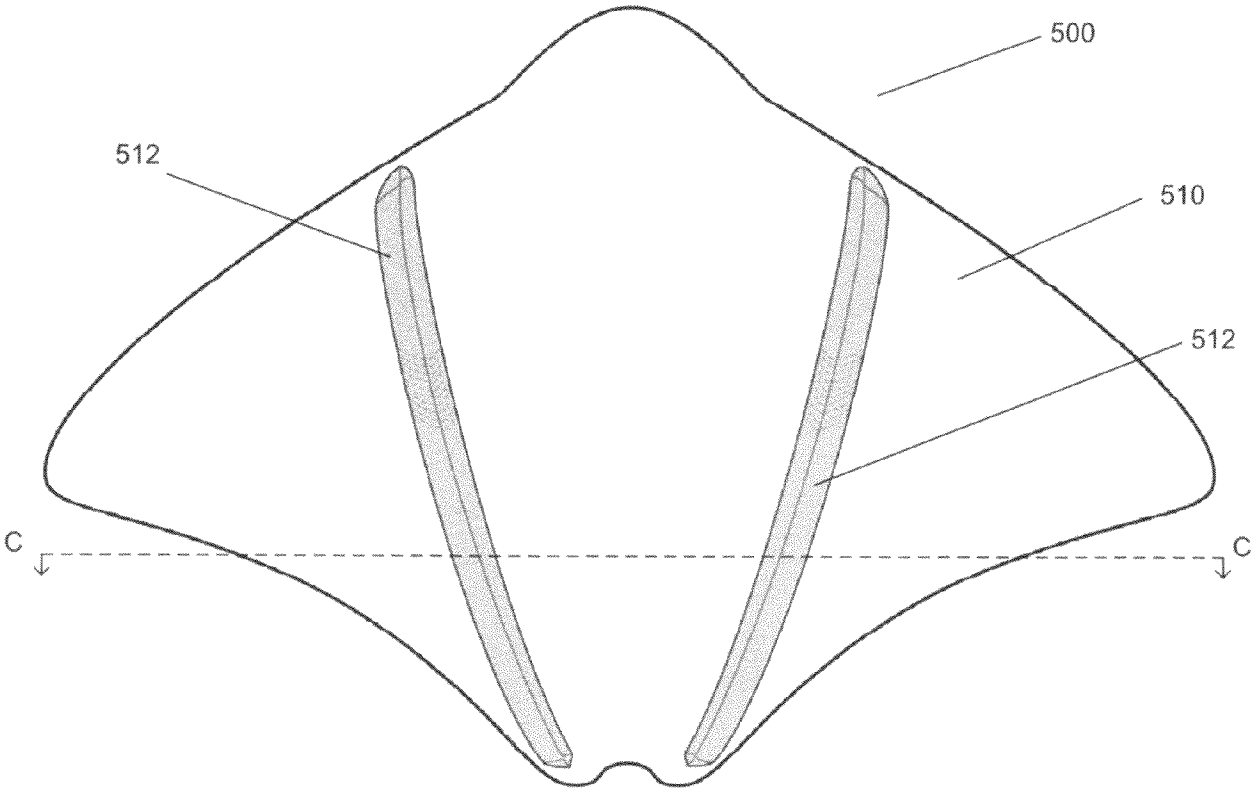
FIG. 5A is a diagram illustrating a bottom view of a water sports device in accordance with another exemplary embodiment of the invention.
Figure 5B:
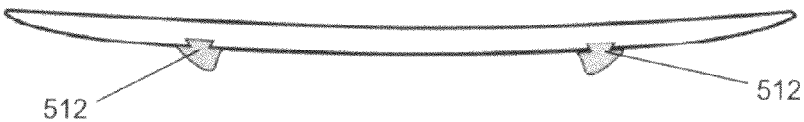
FIG. 5B is a diagram illustrating a section view of the exemplary water sports device of FIG. 5A taken along line C-C, as indicated in FIG. 5A.

Referring now to FIGS. 5A and 5B, diagrams are shown illustrating a bottom view and a section view of a water sports device 500 in accordance with another exemplary embodiment of the invention. As shown, the water sports device 500 includes a riding board 510 and is configured in a similar manner to the water sports device 100 of FIG. 1A. Water sports device 500 has a large width-to-length ratio (for example greater than 1:1), thus providing increased stability. The water sports device 500 may further include rails labeled generally as 512 that protrude below the bottom surface of the riding board 510 and extend generally from the forward section of the riding board 510 to the rear section of the riding board. By providing a large width-to-length ratio, such as the one depicted in FIG. 5A for example, planing can be routinely achieved even without the existence of rails, regardless of the age, size, skill level or experience of the user. Thus, the rails are not as necessary as with respect to other embodiments having a large width-to-length ratio. Of course, the existence of rails in the various embodiments (see generally FIG. 2A through FIG. 2I for illustrative, non-limiting structural variants) including those embodiments having a large width-to-length ratio, do allow for the channeling of water to the rear of the device, thereby increasing the lift provided to the rear section of the riding board.

The rails 512 are configured such that they are spaced closer to one another moving from the forward section of the riding board 510 to the rear section of the board. In this manner the rails 512 provide a means for channeling water that moves across the front section of the riding board 510 towards a relatively smaller area of the rear section of the board, thus increasing the lift provided to the rear section of the riding board than would exist without such rails 512. The rails 512 may extend along the full length of the riding board 510 or along a partial length of the board as shown. By way of example, the rails 512 may extend approximately 0.5 inches to 0.75 inches below the bottom surface of the riding board 510.

Figure 6A:
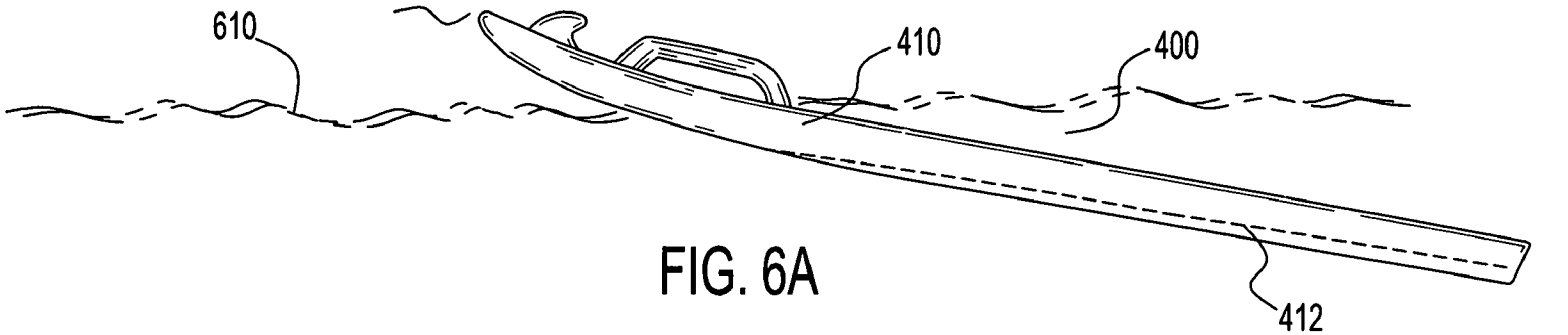
FIG. 6A is a diagram illustrating a side view of an exemplary water sports device at a first stage of use.
Figure 6B:
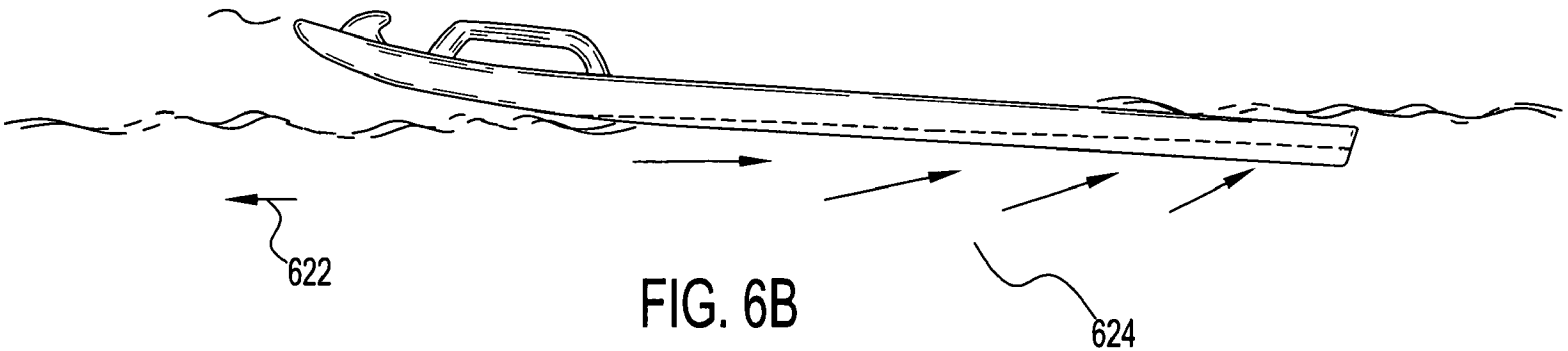
FIG. 6B is a diagram illustrating a side view of an exemplary water sports device at a second stage of use.
Figure 6C:
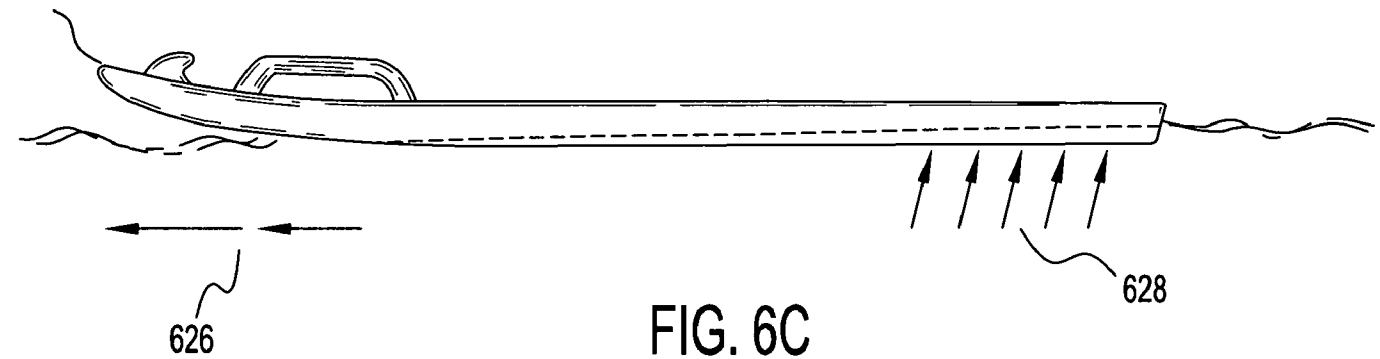
FIG. 6C is a diagram illustrating a side view of an exemplary water sports device at a third stage of use.

Referring now to FIG. 6A, FIG. 6B and FIG. 6C, diagrams are shown illustrating the hydrodynamic effects of the rails 412 shown in FIG. 4A. It should, however, be understood that experienced riders can achieve the forces depicted particularly in FIG. 6B and FIG. 6C even without the presence of rails. The rails do assist particularly the inexperienced, elderly or out-of-shape rider (among others) with respect to planing. Similarly, boards having a large width-to-length ratio also assist the aforementioned riders and others achieve planing even without the presence of rails, which if present would further assist with respect to planing.

As discussed, riding boards with relatively small width-to-length ratios have advantages related to increased maneuverability. However, in operation, it can be difficult for a rider to achieve a steady plane position with such narrower water recreation devices. The steady plane position is a position in which the riding board is oriented substantially parallel to and above the surface of the water. This position is desirable because it allows the user to easily transition to a standing position. In use, the rider transitions from a starting position in which they lay on a stationary riding board to a standing position in which they stand on the riding board while being pulled through the water by a water vehicle such as a boat. When the rider is in the starting position a large portion of the rider's weight is distributed to the rear section of the riding board. This uneven weight distribution causes the rear section of narrower boards to fall below the surface of the water 610. FIG. 6A illustrates the device 400 in an exemplary starting position in which the rear section of the riding board 410 is below the surface of the water 610 and the front of the riding board is raised above the surface of the water 610. As discussed, the device 400 may be coupled to the boat via a tow rope (see e.g. tow rope 900 in FIG. 9) that attaches to a tow hook assembly on the device. When the boat first begins pulling the device 400 through the water the angled positioning of the riding board 410 causes the board to resist movement through the water. The angled positioning of the riding board thus causes the device to be difficult to kneel or stand on. Moreover, the resistance of the board creates tension in the tow rope that makes it difficult for the rider to remove the tow rope from the tow hook assembly while maintaining control of the device 400. However, as previously discussed, the exemplary water sports device 400 includes rails 412 that channel water flow across the bottom surface of the riding board to generate increased lift at the rear end of the board. Arrows 622 illustrate this channeling of water towards the rear end of the riding board 410. Lift is generated shortly after the device 400 begins moving through the water, thus quickly compensating for the downward force applied by the weight of the rider on the rear section of the riding board 410. FIG. 6B illustrates the improved positioning of the device 400 just after the boat has begun pulling the device forward (as indicated by arrow 624). As shown the rear section of the riding board 410 quickly moves closer to the surface of the water 610 thus allowing the user to more easily begin transitioning to the standing position. FIG. 6C illustrates the positioning of the device 400 after the boat has begun pulling the device forward with enough speed (as indicated by arrow 626) to generate sufficient lift (as indicated by arrows 628) to substantially overcome the downward force applied by the rider thereby allowing the riding board 610 to achieve the steady plane position. In this position the device 400 generates little resistance as it moves through the water 610 thereby decreasing the tension in the tow rope. At this point the rider is able to easily transition to the standing position due to both the improved positioning of the board and the ease with which they may remove the tow rope from the tow hook assembly. It is noted that rails may be included in each of the contemplated water sports devices including those having riding boards with higher width-to-length ratios (e.g. the riding board shown in FIG. 2B). While the use of such rails with riding boards having smaller width-to-length ratios shows a more significant improvement than when used with boards having larger width-to-length ratios, it is to be understood that a measured improvement is seen in all such embodiments.

Figure 7A:
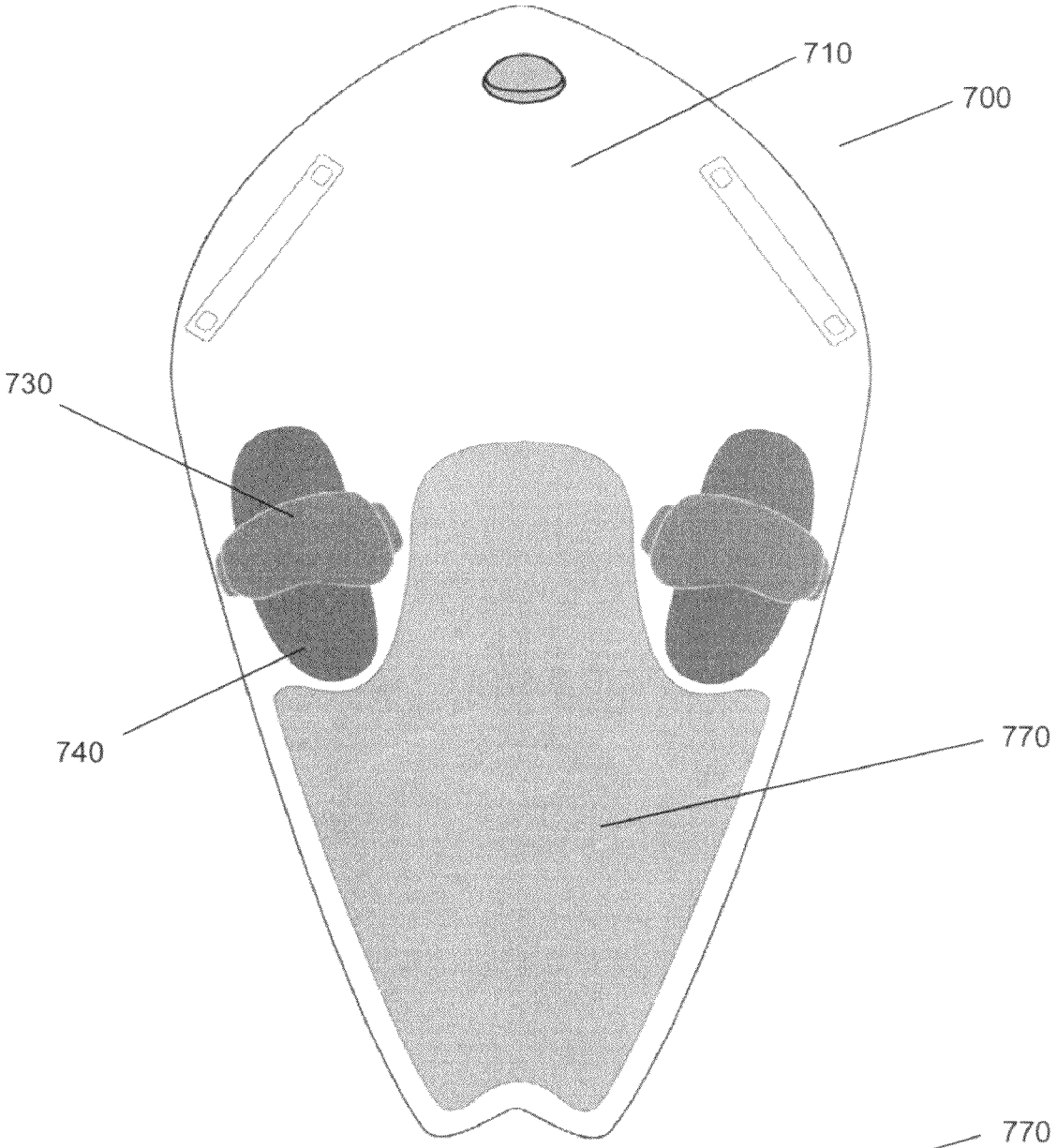
FIG. 7A is a diagram illustrating a top view of a water sports device in accordance with another exemplary embodiment of the invention.
Figure 7B:
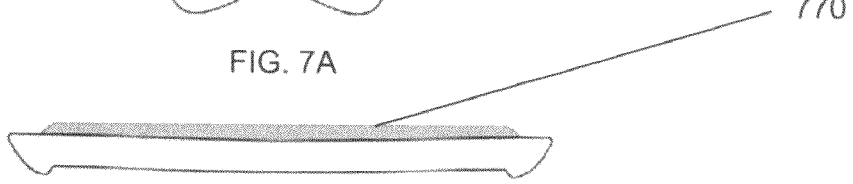
FIG. 7B is a diagram illustrating an end view of the exemplary water sports device of FIG. 7A.

Referring now to FIG. 7A and FIG. 7B, diagrams are shown illustrating a top view and an end view of a water sports device 700 in accordance with another exemplary embodiment of the invention. As shown, the water sports device 700 includes a riding board 710 and is configured in a similar manner to the water sports device 100 of FIG. 1. Water sports device 700 also includes knee padding 770 adhered to top side of the riding board 710. As shown, the knee padding 770 covers a substantial area of the rear section of the top surface of the riding board 710 as well as a section between foot bindings 730 and foot grips 740. The knee padding 770 is preferably comprised of neoprene but may also be comprised of a material such as but not limited to rubber or other waterproof materials, with suitably flexible waterproof materials and skid resistant materials likewise being appropriate.

Figure 8A:
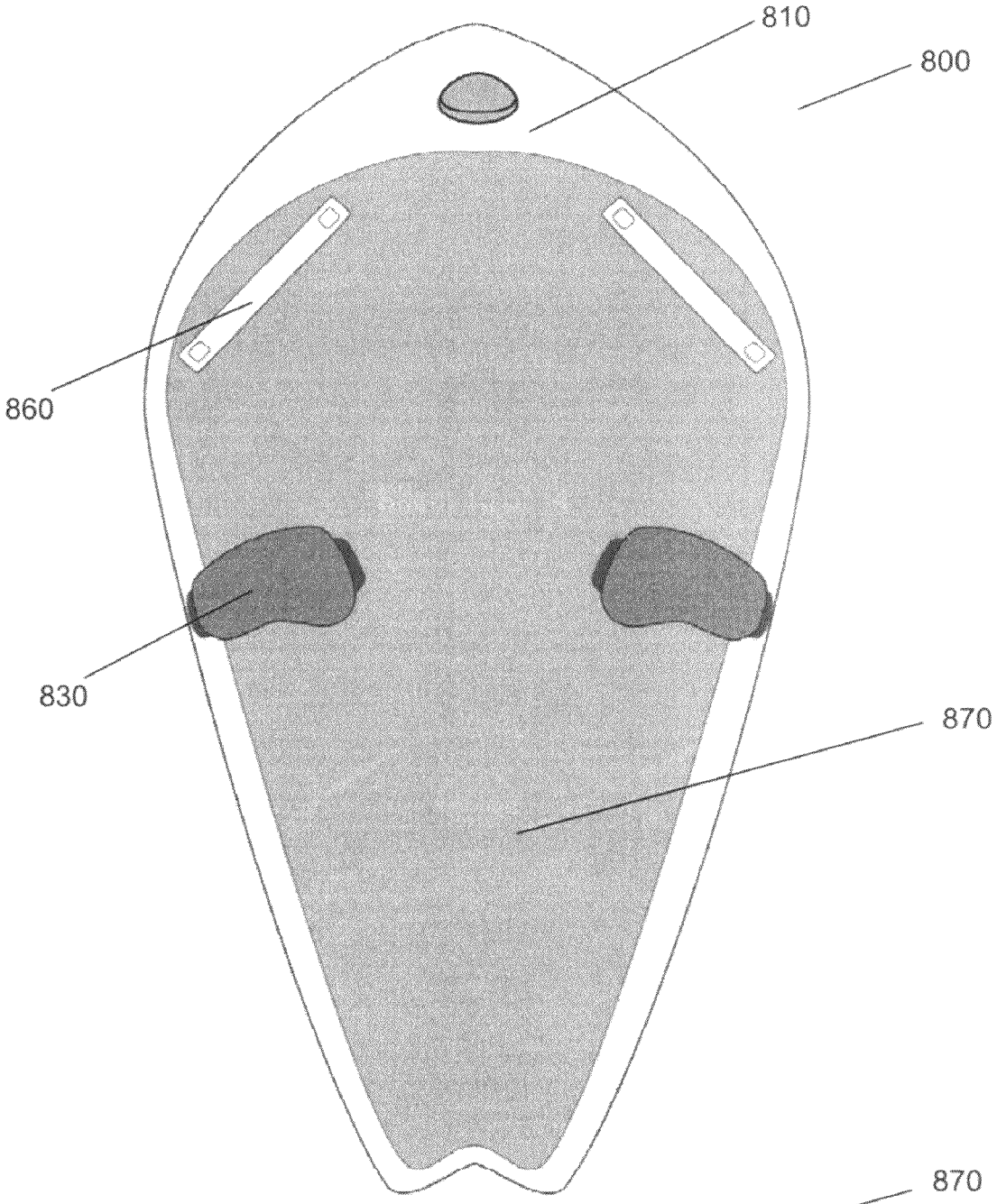
FIG. 8A is a diagram illustrating a top view of a water sports device in accordance with another exemplary embodiment of the invention.
Figure 8B:
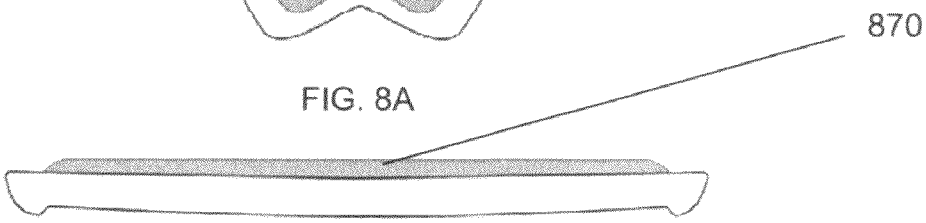
FIG. 8B is a diagram illustrating an end view of the exemplary water sports device of FIG. 7A.

Referring now to FIG. 8A and FIG. 8B, diagrams are shown illustrating a top view and an end view of a water sports device 800 in accordance with another exemplary embodiment of the invention. As shown, the water sports device 800 includes a riding board 810 and is configured in a similar manner to the water sports device 100 of FIG. 1. Water sports device 800 also includes knee padding 870 adhered to top side of the riding board 110. As shown, the knee padding 870 covers a substantial area of the entire top surface of the riding board 810. The knee padding 810 is disposed between the top surface of the riding board 810 and handles 860. The knee padding 810 is also disposed between the top surface of the riding board 810 and foot bindings 830 thus further acting as a foot grip. The knee padding 870 is preferably comprised of neoprene but may also be comprised of a material such as but not limited to rubber or other waterproof materials, with suitably flexible waterproof materials and skid resistant materials likewise being appropriate.

Figure 9A:
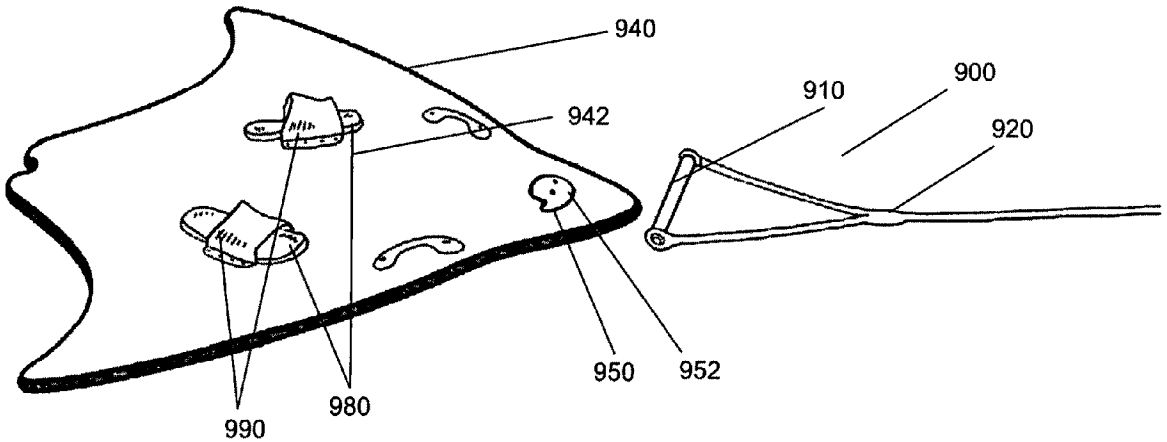
FIG. 9A is a diagram illustrating an exemplary water sports device and tow rope configured in a disconnected state prior to use.

Referring now to FIG. 9A through FIG. 9H, diagrams are shown illustrating a method of using the exemplary water sports device 100. As shown in FIG. 9A, a water sports device 940 is initially disconnected from a tow rope 900. As discussed the tow rope includes a tow bar 910 and a rope 920 attached to the end of a boat or similar water vehicle (not shown).

Figure 9B:
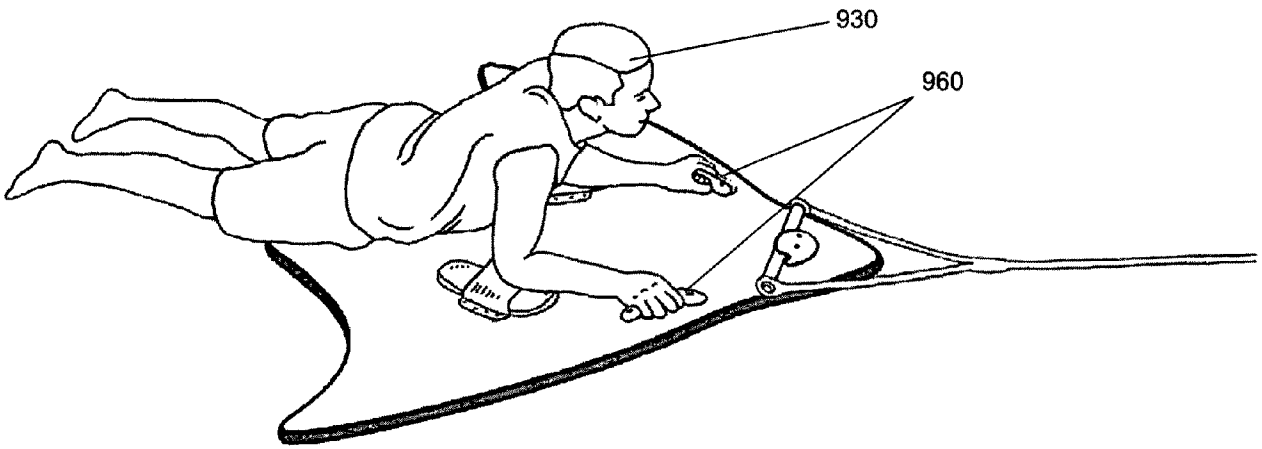
FIG. 9B is a diagram illustrating the exemplary water sports device and tow rope configured in a connected state along with a rider in a first position.

Referring now to FIG. 9B, a diagram is shown illustrating the exemplary water sports device 940 and tow rope 900 configured in a connected state along with the rider 930 in a first or starting position. At a first step, the rider 930 lays with torso on the riding board 942 and allows legs and feet to rest in the water. Before the boat begins to move the rider 930 will first hook the tow bar 910 into a concave section of tow hook 952. Once the tow bar 910 is connected to the water sports device 940, the rider 930 then grasps the handles 960. At this point the rider 930 has established the first position which is the starting position. This first position is to be maintained until the boat pulls the water sports device 940 up to a steady plane on the water. The water sports device 940 has reached a suitably steady plane when the riding board 942 is oriented in a substantially parallel position relative to the surface of the water. With respect to using the board, a substantially parallel orientation is intended to cover those riding positions that achieve a suitably steady planing. As such, a substantially parallel orientation for one rider may differ from a substantially parallel orientation preferred by another rider, varying relative to comfort level unique to a particular rider and dictate by the rider being comfortable enough with the level of planing achieved so as to take the next steps toward kneeling and/or standing on the board. It should also be noted that in this figure the rider 930 is holding on to the handles 960 on either side of the riding board 942, not the tow rope 900, after it has been attached.

Figure 9C:
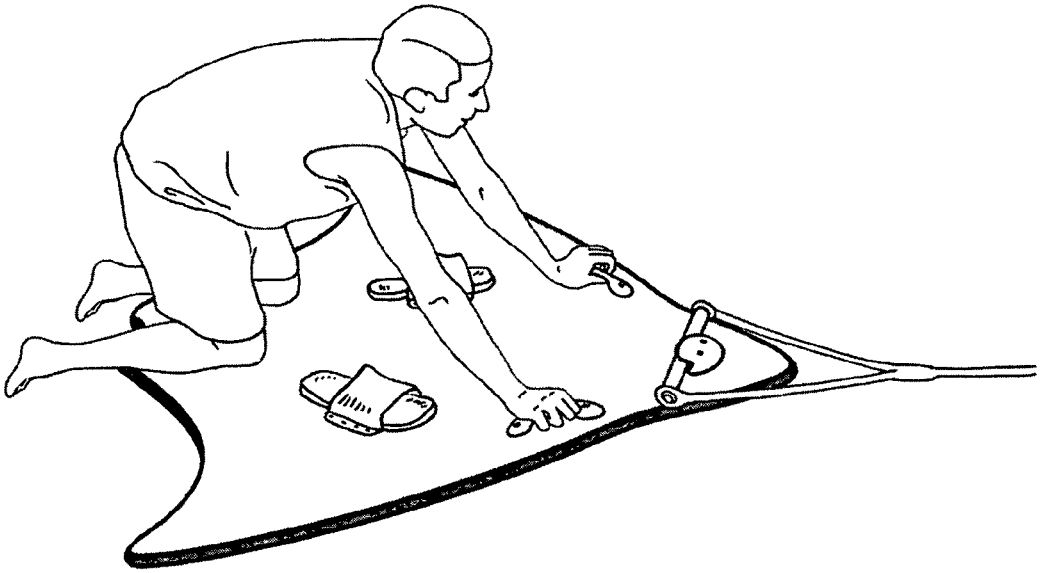
FIG. 9C is a diagram illustrating the exemplary water sports device and tow rope configured in a connected state along with the rider in a second position.

Referring now to FIG. 9C, a diagram is shown illustrating the exemplary water sports device 940 and tow rope 900 configured in a connected state along with the rider 930 in a second position. As the boat pulls the water sports device 940 and the riding board 942 begins to plane on the surface of the water, the rider 930 can begin to pull themselves to a kneeling position on a back section of the top surface of the riding board 942. FIG. 9C shows the rider having established the second position in which they are kneeling on the riding board 942. It is noted that in the second position, the rider 930 continues to grasp the handles 960 for support, and that the device 940 continues to be pulled directly by the tow rope 900 that is still attached to the tow hook 952.

Figure 9D:
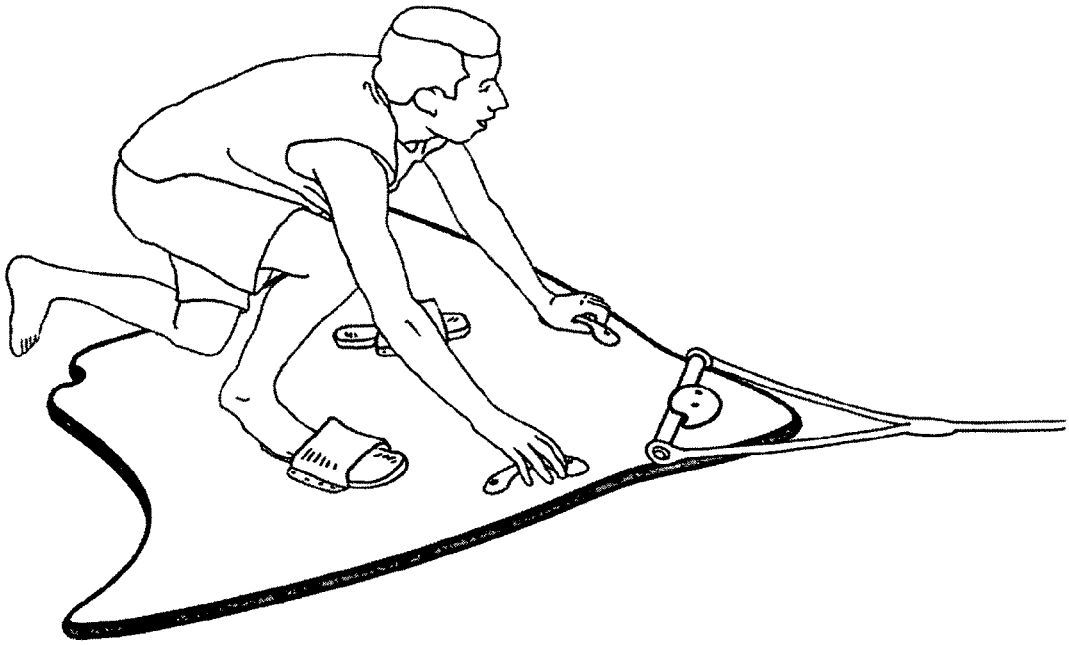
FIG. 9D is a diagram illustrating the exemplary water sports device and tow rope configured in a connected state along with the rider in a third position.
Figure 9E:
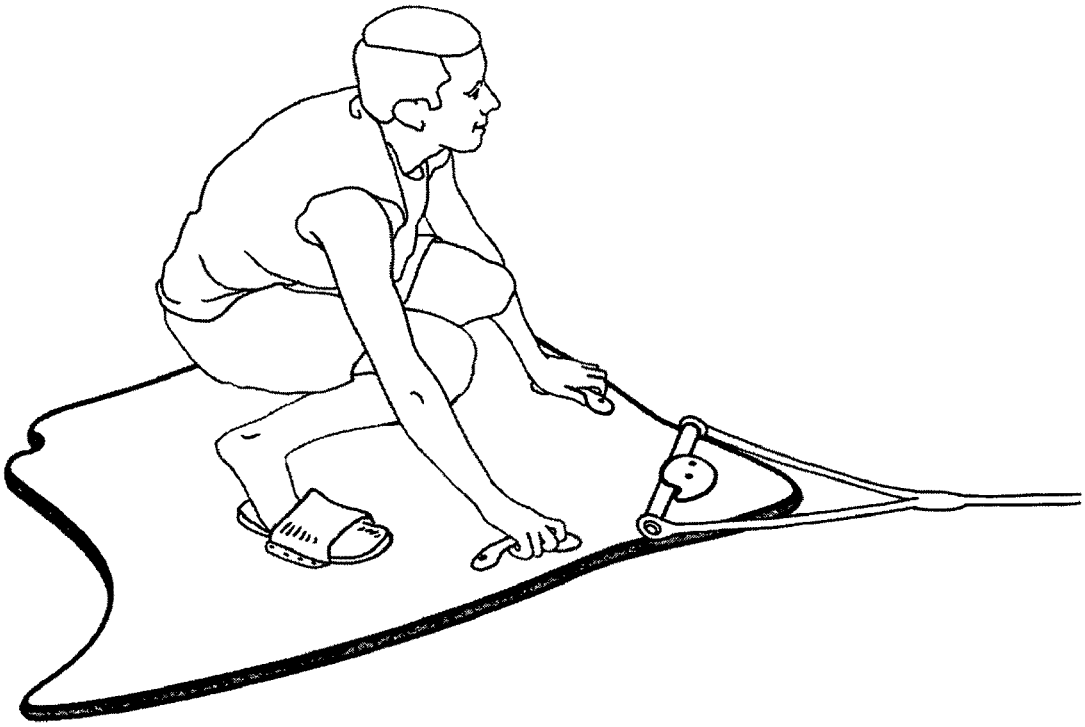
FIG. 9E is a diagram illustrating the exemplary water sports device and tow rope configured in a connected state along with the rider in a fourth position.

Referring now to FIG. 9D and FIG. 9E, diagrams are shown illustrating the exemplary water sports device 940 and tow rope 900 configured in a connected state along with the rider 930 in third and fourth positions respectively. At this step, the rider 930 begins to move forward on the riding board 940 by placing one foot at a time on to the foot grips 980 located on either side of the board. FIG. 9D shows the rider 930 having established the third position in which one foot as been placed in to one of the foot grips 980 and under one of the foot bindings 990. FIG. 9E shows the rider 930 having established the fourth position in which both feet are placed on the foot grips 980 and under the foot bindings 990. In the fourth position the rider 930 has established a crouched riding position that provides sufficient stability to allow the rider 930 to subsequently remove their grasp of the handles 960 and take hold of the tow bar 910. It is noted that in the third and fourth positions, the rider 930 continues to grasp the handles 960 for support, and that the device 940 continues to be pulled directly by the tow rope 900 that is still attached to the tow hook assembly 950.

Figure 9F:
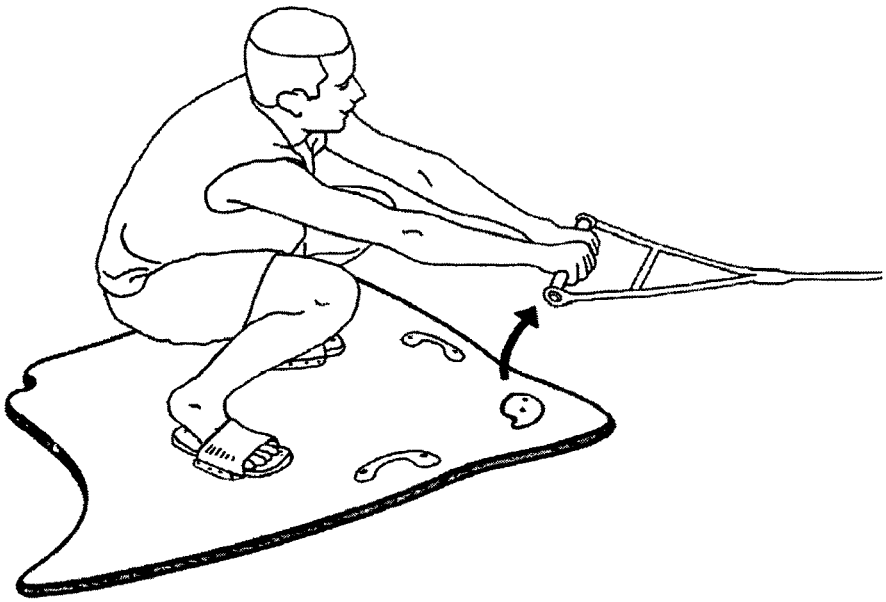
FIG. 9F is a diagram illustrating the exemplary water sports device and tow rope configured in the disconnected state during use along with the rider in a fifth position.

Referring now to FIG. 9F, a diagram is shown illustrating the exemplary water sports device 940 and tow rope 900 configured in the disconnected state during use along with the rider 930 in a fifth position. At this step, the rider 930 slowly and easily disengages the tow bar 910 from the tow hook assembly 950 and establishes the fifth position which is sufficiently stable to allow them to use their own energy to maintain the connection between the boat and themselves. In the fifth position the rider 930 maintains a crouched position for best balance and to prepare to stand slowly while holding the tow rope 900 in front of them.

Figure 9G:
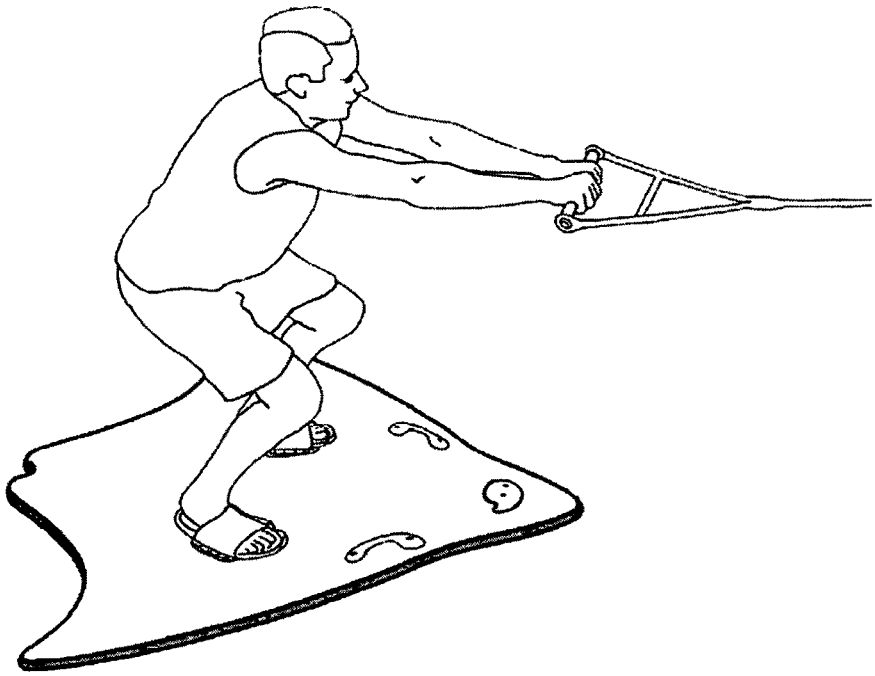
FIG. 9G is a diagram illustrating the exemplary water sports device and tow rope configured the disconnected state during use along with the rider in a sixth position.
Figure 9H:
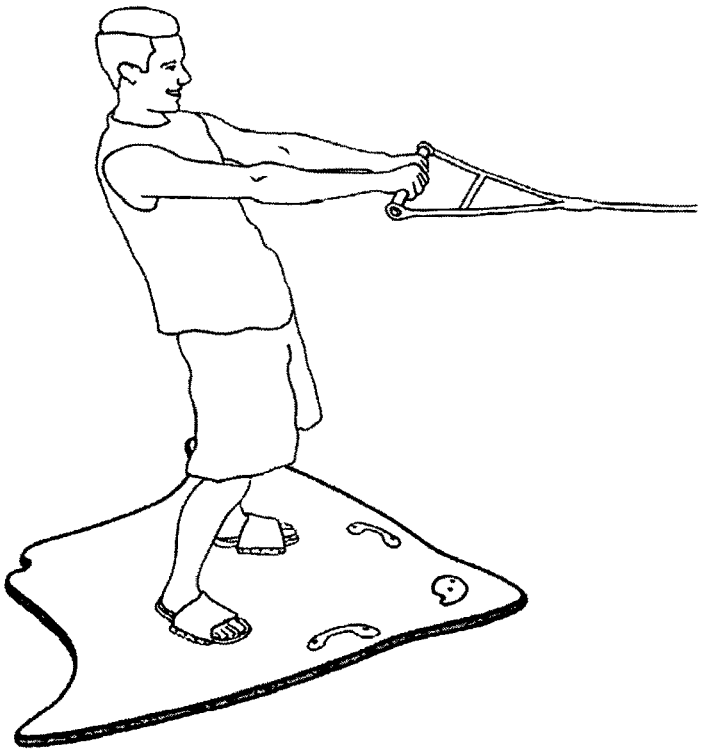
FIG. 9H is a diagram illustrating the exemplary water sports device and tow rope configured in the disconnected state during use along with the rider in a seventh position.

Referring now to FIGS. 9G and 9H, diagrams are shown illustrating the exemplary water sports device 940 and tow rope 910 configured in the disconnected state during use along with the rider 930 in sixth and seventh positions respectively. At this step, the rider 930 first transitions to the sixth position in which they begin to stand with feet apart while maintaining a direct connection to the boat via direct connection to the tow rope 910. During the next and final step, the rider 930 rises to a full standing position, and assumes a forward facing stance: feet apart, shoulders square, hips forward, and knees slightly bent or straight. The rider has thus established the seventh position in which they may remain connected to the board via foot bindings 990 and to the boat via tow rope 910. In the seventh position the water sports device 940 provides the rider 930 with sufficient balance and stability to ride in a standing position and to perform tricks or other advanced maneuvers.

In an alternate embodiment, the riding board may include a first layer formed from two symmetrical sections. The two sections may include a left section and a right section, the left and right sections being attached to one another by way of hinges or similar pivoting fasteners. The left and right sections may be comprised of wood, molded plastic, or foam with a fiberglass coating. The riding board may also include an inflatable second layer positioned above the two top layers. The second layer may be attached to the first layer by way of an adhesive. The first layer and the second inflatable layer may be configured such that the riding board may be folded in half with the top layer in a deflated state. When inflated the top layer may hold the bottom layer in an open state suitable for riding, and additionally serve as a padding that creates a more comfortable experience to the rider.

In another alternate embodiment, the riding board may include removable outer sections for increasing or decreasing the overall width or shape of the board. In this manner the rider may remove or add additional sections to increase or decrease the difficulty level of the board respectively. Elastic rings may also be provided, each ring being sized to securely fit around the full perimeter of the riding board with different sections attached.

Thus, a water recreation device and method of use is contemplated having advantages including improved stability, maneuverability and ease of use. The contemplated device allows for riding in a side-by-side foot position on a single board, making the ride much more natural and comfortable relative to existing solutions. The contemplated water recreation device may include a tow hook assembly and handles that are configured to allow a rider to more easily transition to a standing position while riding the device. The contemplated device may also include foot bindings or foot grips for added stability. Additional embodiments of the device may alternately include elongated rails disposed on the bottom surface of the riding board. Such rails are adapted to channel water toward the rear bottom section of the board to cause the device to achieve an orientation relative to the surface of a body of water that further improves the ease of transitioning to a standing position.

While the present invention has been described above in terms of specific embodiments for purposes of illustration, it is to be understood that the invention is not limited to these disclosed embodiments. Likewise, while "the invention" or "present invention" may have been referred to at times in this disclosure those terms are not intended to limit the scope of this disclosure or to suggest in any way that there is a single version or embodiment. While the invention relates generally to a water sports device, the water sports devices that fall within the scope of this disclosure may include a variety of optional features, which do not need to be present in every version or embodiment. Various modifications and changes can be made without departing from the spirit of the invention. In fact, modifications and other embodiments of the invention will also come to mind of those skilled in the art to which this invention pertains, and which are intended to be and are covered by both this disclosure and the appended claims. It is indeed intended that the scope should be determined by proper interpretation and construction of the appended claims and their legal equivalents, as understood by those of skill in the art relying upon the disclosure in this specification and the attached drawings.

What is claimed is:

1. A water recreation device comprising:

a riding board having a top surface, a bottom surface, a front section, a middle section, and a rear section;

a tow hook disposed on the front section of the riding board;

first and second handles disposed side-by-side on the front section of the top surface of the riding board aft of the tow hook;

first and second foot bindings disposed side-by-side on the middle section of the top surface of the riding board aft of the first and second handles; and a plurality of rails protruding from the bottom surface of the riding board and extending substantially the full length of the riding board;

wherein the tow hook includes a rearward-facing concave section sized to receive a tow rope bar and positioned to allow the riding board to be pulled in a forward direction by a tow rope attached to the tow rope bar, wherein the first and second handles and the first and second foot bindings are configured for simultaneous engagement by a rider to position the rider in a crouching stance facing in a forward direction, wherein the plurality of rails are disposed relative to a longitudinal axis along the bottom surface of the riding board, the longitudinal axis projecting rearwardly from a reference location substantially central to the front section, and each of the plurality of rails is laterally spaced closer to the longitudinal axis nearest the rear section of the riding board than the each of the plurality of rails is laterally spaced from the longitudinal axis nearest the front section of the riding board thereby allowing the water that moves across the bottom surface nearest the front section of the riding board to funnel towards the bottom surface nearest the rear section of the riding board for the purpose of generating lift force against the bottom surface of the riding board.

2. The water recreation device of claim 1, wherein the riding board is sufficiently wide to allow the rider to stand facing in a forward direction and with feet spaced approximately shoulder-width apart, and wherein the each of the plurality of rails protrudes from the bottom surface of the board about 0.25 inches to about 1.5 inches.

3. The water recreation device of claim 2, wherein the riding board is wider than it is long, length being measured from an outermost edge of the front section to an outermost edge of the rear section and width being measured from an outermost edge of a left side of the middle section to an outermost edge of a right side of the middle section.

4. The water recreation device of claim 2, wherein the riding board includes a rear edge having a concave cutout section.

5. The water recreation device of claim 1, wherein the tow hook is removably attached to the top surface of the riding board by way of bolts protruding from the top surface of the riding board.

6. The water recreation device of claim 3, further comprising one or more knee pads disposed on the top surface of the riding board and coupled to the top surface of the riding board by way of an adhesive.

7. The water recreation device of claim 6, further comprising first and second foot pads disposed on the top surface of the riding board and coupled to the top surface of the riding board by way of an adhesive.

8. The water recreation device of claim 7, wherein the first and second foot pads are spaced shoulder-width apart.

9. A method of riding a water recreation device on a body of water comprising:

placing a water recreation device into a body of water, the water recreation device comprising:

a riding board having a top surface, a bottom surface, a front section, a middle section, and a rear section;

a tow hook disposed on the front section of the riding board;

first and second handles disposed side-by-side on the front section of the top surface of the riding board aft of the tow hook; and first and second foot bindings disposed side-by-side on the middle section of the top surface of the riding board aft of the first and second handles;

attaching a tow rope to said tow hook, said tow rope also attached to a water vehicle;

grasping the first and second handles of the water recreation device to establish a prone start position by a rider;

maintaining said prone start position by the rider until the riding board has achieved a substantially parallel position relative to the surface of the water;

achieving a kneeling position by the rider by placing both knees on the top surface of the riding board;

achieving a crouching position by the rider by placing a first foot into the first foot binding and then placing a second foot into the second foot binding;

grasping the tow rope by the rider by releasing the first and second handles;

removing the tow rope from the tow hook by the rider;

standing on the riding board by the rider while continuing to grasp the tow rope.

10. A water recreation device comprising:

a riding board having a top surface, a bottom surface, a bow, a stern, a port, and a starboard;

first and second handles disposed side-by-side on the top surface of the riding board aft of the bow; and first and second foot bindings disposed side-by-side on the top surface of the riding board aft of the first and second handles; and a plurality of rails protruding from the bottom surface of the riding board and extending substantially the full length of the riding board;

wherein the first and second handles and the first and second foot bindings are configured for simultaneous engagement by a rider to position the rider in a crouching stance facing the bow of the riding board, wherein the plurality of rails are disposed relative to a longitudinal axis along the bottom surface of the riding board, the longitudinal axis projecting rearwardly from the bow, and each of the plurality of rails is laterally spaced closer to the longitudinal axis nearest the stern of the riding board than the each of the plurality of rails is laterally spaced nearest the bow of the riding board thereby allowing the water that moves across the bottom surface nearest the bow of the riding board to funnel towards the bottom surface nearest the stern of the riding board for the purpose of generating lift force against the bottom surface of the riding board.

11. The water recreation device of claim 10, wherein the riding board is wider than it is long, length being measured from the bow to the stern and width being measured from the port to the starboard and wherein the each of the plurality of rails is disposed in relation to the longitudinal axis at an angle that is greater than 20 degrees.

12. The water recreation device of claim 11, wherein the bottom surface of the riding board includes a rear edge near the stern having a concave cutout section, and wherein the each of the plurality of rails protrudes from the bottom surface of the board about 0.25 inches to about 1.5 inches.

* * * * *